US005566831A

United States Patent [19]

Swenson

[11] Patent Number: 5,566,831

[45] Date of Patent: Oct. 22, 1996

[54] UNITARY BLANK FOR FORMING A MERCHANDISING DISPLAY CONTAINER CONVERTIBLE INTO A MAILABLE CONTAINER

[75] Inventor: Robert E. Swenson, Jeffersonville, Ind.

[73] Assignee: Colorama Creations, a division of Life Lines, Inc., Jeffersonville, Ind.

[21] Appl. No.: 559,361

[22] Filed: Nov. 16, 1995

[51] Int. Cl.[6] ..... B65D 5/54

[52] U.S. Cl. ..... 206/767; 206/806; 229/148

[58] Field of Search ..... 229/148, 92.8, 229/223; 206/767, 736, 806, 216

[56] References Cited

U.S. PATENT DOCUMENTS

| | | | |
|---|---|---|---|
| 3,814,303 | 6/1974 | Smith . | |
| 4,171,763 | 10/1979 | Card | 229/148 X |
| 4,266,671 | 5/1981 | Roccaforte | 229/223 |
| 4,291,807 | 9/1981 | Giordano et al. . | |
| 4,344,533 | 8/1982 | Olsen | 229/223 X |
| 4,360,106 | 11/1982 | Irvine et al. . | |
| 4,949,845 | 8/1990 | Dixon . | |

*Primary Examiner*—Jacob K. Ackun
*Attorney, Agent, or Firm*—Wheat, Camoriano, Smith & Beres, PLC

[57] ABSTRACT

A unitary blank having a multiplicity of fold, cut, and score lines permitting the blank to be folded along the fold and cut lines to form a container attached along a first score line to a display panel adapted to be hung from an arm of a merchandising display unit. The blank defines at least one locking slot and further having a tab connected along a first folding line to a first panel and connected to the display panel along a second score line. The tab is insertable in the slot when the display panel is separated from the container to close the top of the container with the first panel.

11 Claims, 4 Drawing Sheets

UNITARY BLANK FOR FORMING A MERCHANDISING DISPLAY CONTAINER CONVERTIBLE INTO A MAILABLE CONTAINER

BACKGROUND OF THE INVENTION

This invention pertains to a container made from a blank and, more specifically, a container made from a blank capable of being hung on a merchandising display unit arm.

The number of containers made from unitary blanks that can be hung from merchandising display arms are legion. Examples abound in the patent prior art. Representative of such containers that are attached to display panels adapted to be hung from a merchandising display unit may be found in U.S. Pat. Nos. 4,949, 845, 4,360,106, 4,291,807, and 3,814, 303. Several of the mentioned patents have display panels that can be separated from the container along scored lines when the container and its contents are purchased. This is clearly a desirable feature when the container is to be reused in the sense that the contents of the container are removed and returned to the container. periodically. Separating the container from the display panels periodically. Separating the container from the display panels then is important so as to not have the inconvenience of dealing with an extraneous member protruding from the container. Among other things, separation facilitates storage of the container and contents during non- use periods.

In some instances, it may be desirable to use the container for mailing purposes. For example, the contents may contain a roll of drawing paper upon which children may draw and wish to mail to friends and relatives. Such containers of the prior art as illustrated by the aforementioned patents must be carefully wrapped and sealed by exterior articles such as tape or cord in order to meet postal regulations for mailing. It is a paramount object of the present invention to provide for a unitary blank that can be fashioned into a container capable of being hung from the arm of a merchandising display unit arm and, after removal, be fashioned into a container capable of being mailed without further preparation of the container. Still another important object of the present invention is to provide for a unitary blank that can be fashioned into a container in which the display panel can be separated from the container simultaneously freeing a locking tab to be used to lock the container for mailing once the contents have been placed into the container. These and other important objects of the present invention will become apparent upon a reading of the detailed description in concert with the drawings.

SUMMARY OF THE INVENTION

The present invention includes a blank adapted to be folded into a container to be hung from a point-of-purchase merchandising display unit and then, when removed from the arm, locked in a manner acceptable for mailing. The blank comprises a set of panels, including a first panel defining a first slot and a first locking tab flap for engagement with the first slot, and a merchandising display panel adapted to be fastened to the merchandising display unit. The first set of panels are connected along fold lines such that, when the first set is folded along the fold lines, a container is formed attached through a second panel of the first set along a score line to the display panel. The locking tab is connected along a fold line to the second panel and along a score line to the merchandising panel such that the locking tab is usable only when the tab is separated from the merchandising panel. Upon separation of the merchandising panel, the locking tab may be inserted into the slot making the container "mailable".

DETAILED DESCRIPTION OF THE PREFERRED EMBODIMENT

Figure 1:
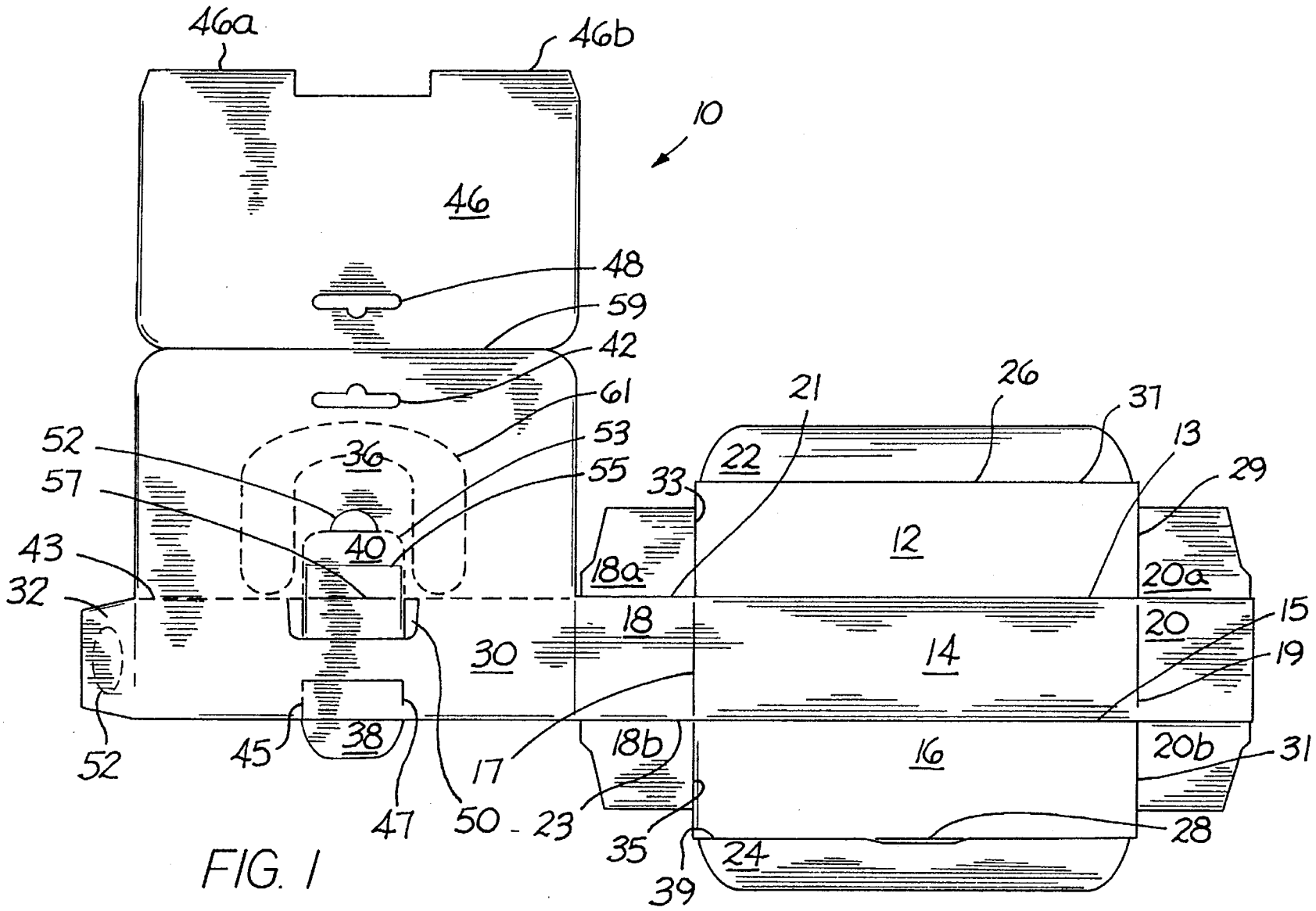
FIG. 1 is top plan view of a blank in accordance with the present invention.

Referring first to FIG. 1, the blank 10 may be seen to have a first set of panels comprising panels 12, 14 and 16 connected along respective fold lines 13 and 15. Side panel 14 is connected by fold lines 17 and 19, respectively, to a pair of end panels 18 and 20. Each end panel 18 and 20 is connected, respectively, along fold lines 21, 23 and 25, 27 to a pair of top and bottom flaps 18*a*, 18*b* and 20*a*, 20*b*. Similarly, side panels 12 and 16 are, respectively, connected along fold lines 29, 33 and 31, 35 to side flaps 18*a*, 20*a* and 18*b*, 20*b*. Side panel 12, connected along a fold line 37 to locking flap 22, collectively with flap 22 defines a slit-type slot 26 along fold line 37. In a similar manner, side panel 16, connected along a fold line 39 to locking flap 24, collectively with flap 24 defines a slit-type slot 28 along fold line 39.

Side flap 18 is connected along fold line 41 to the remaining side panel 30 that collectively with panels 12, 14, and 16 ultimately form the four sides of a container. Panel 30 is itself connected along a scored line 43 to an advertising panel 36. Additionally, panel 30 is connected along fold line 45 to side flap 32 and to a pair of locking tabs 38, 40. Tab 38 is cut separate from side panel 30 along lines 45 and 47, but is connected to panel 30 along fold line 49. Tab 40 extends from a cut out area 50 in panel 30, but is connected to panel 30 along folding line 51. Tab 40 is also connected to panel 36 along a scored line 53 that extends upward from scored line 43 to a finger grip aperture 52 defined in panel 36. Finally, tab 40 has a pair of folding lines 55 and 57 for use when tab 40 is employed in a locking manner.

Figure 2:
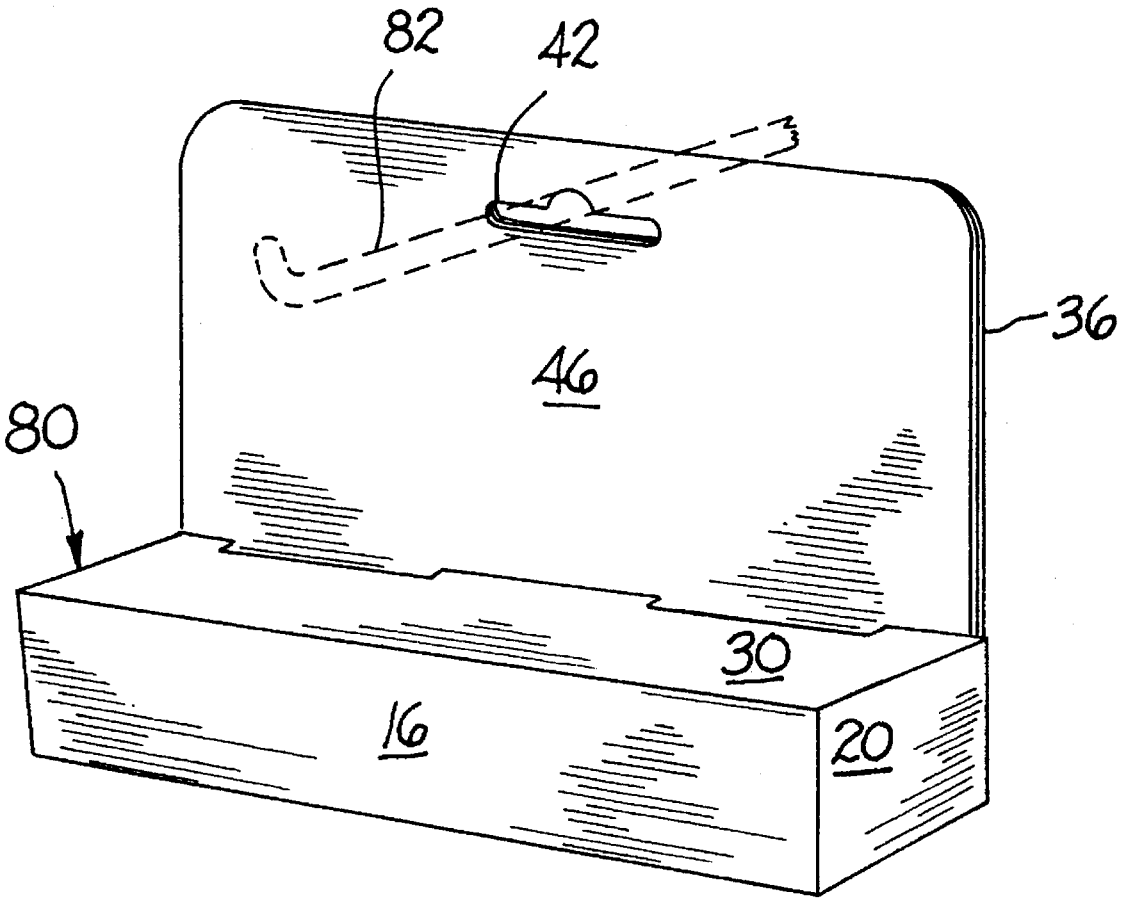
FIG. 2 is a perspective of a box assembled from the blank of FIG. 1 for use as in point-of-purchase advertising.

Rear advertising panel 36 is provided with an aperture 42 and is connected along fold line 59 to front advertising panel 46 having an aperture 48. Apertures 42 and 48 are adapted to register when panels 36 and 46 are folded together in an abutting relationship along fold line 59 as seen in FIG. 2. Panel 46 is provided with a pair of extensions 46*a* and 46*b* such that, when the panels 36 and 46 are folded into the abutting relationship, they extend a short distance below scored line 43 on both sides of cut out 50 as perhaps best illustrated in FIG. 4. The extensions 46*a* and 46*b* provide integrity to and strength to the region bounding scored line 43.

Figure 3:
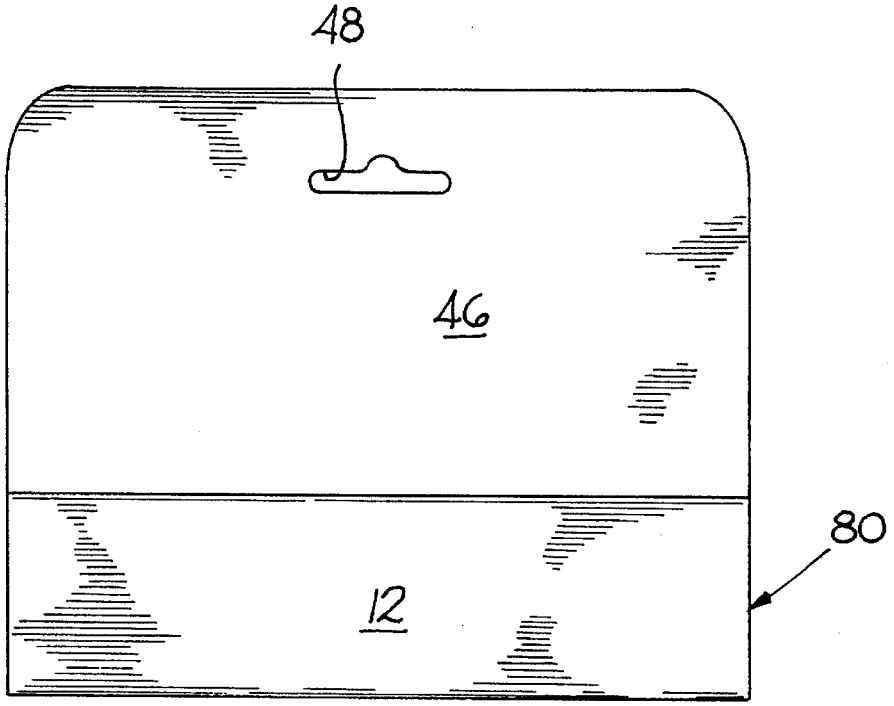
FIG. 3 is a front elevation view of the box of FIG. 2.
Figure 4:
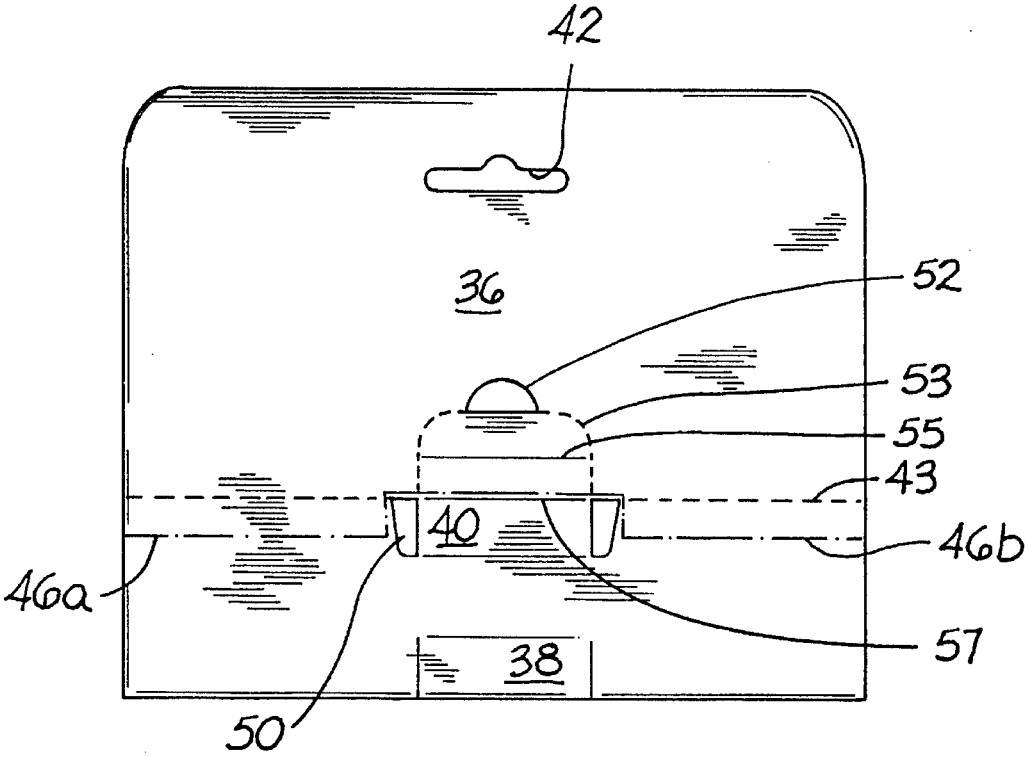
FIG. 4 is a back elevation view of the box of FIG. 2.

Before assembly, adhesive is supplied to flap 32 on the side that ultimately will abut flap 20 and to panel 46 in regions adjacent to score line 53 and above score line 43 as shown by the dashed area 61. During assembly of the blank into the first form, i.e., a container adapted to be attached to an arm of a point of purchase display, panel 46 is folded along line 59 to abut panel 36 and adhered thereto along the adhesive region 61. Next, panels 14 and 30 are folded along lines 17 and 41 to form the front and back of the container with side flap 32 adhered to the inside surface of end panel 20 with top and bottom panels 18*a* and 20*a* tucked beneath side panel 12 and top and bottom panels 18*b* and 20*b* tucked beneath side panel 16. Flaps 22 and 24 fold beneath panel 30 forming a container 80 as best seen in FIG. 2. Once the contents have been placed into container, tab 38 may be inserted into slot 24 locking side 30 to side 16. As stated above, flap 22 is snugly secured behind side 30 but is not in an locking engagement therewith. Container 80 and its advertising panels 36, 46 are now ready to be hung by the opening defined by the registry of apertures 42 and 48 on point-of-purchase display arm 82 shown in dotted lines in FIG. 2. FIGS. 3 and 4 illustrate the front and rear views of container 80 as it would appears when hanging on the merchandising display unit arm.

Figure 5:
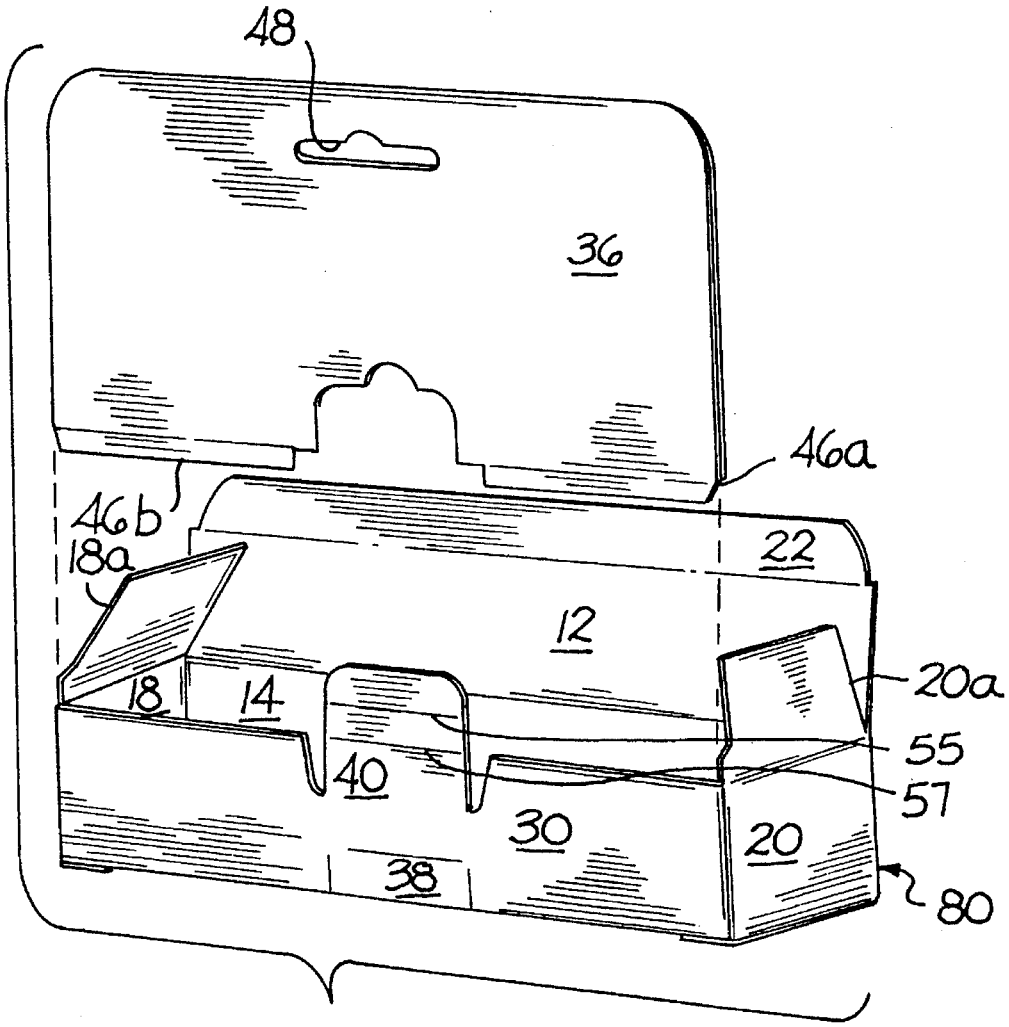
FIG. 5 is a perspective view of the advertising panel being separated from the set of panels forming the box of FIG. 2 with the lid of the box open.
Figure 6:
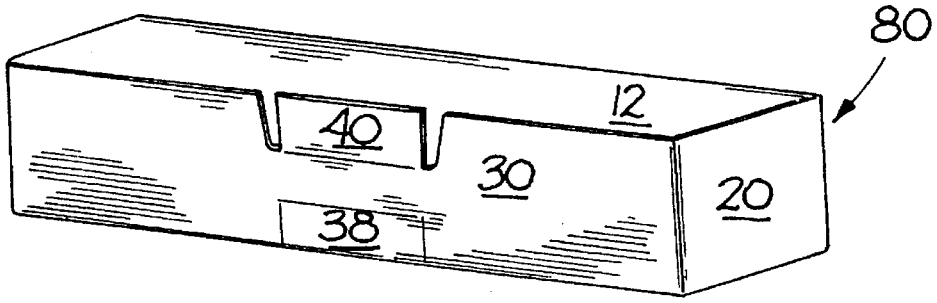
FIG. 6 is a front perspective of the separated panels of FIG. 5 formed into a mailable container.

Reference is now made to FIG. 5 and 6 to demonstrate the convertibility of the container 80 into a mailable container. Once purchased, container 80 can be separated from panels 36 and 42 along scored line segment 53 and tab 40 freed from connection with panel 36 by separation therefrom along score line 53 as shown in the exploded perspective of FIG. 5. Panels 36, 42 may then be discarded. The contents then may be removed by opening "top" side 12 since flap 22 and side 12 are not secured to side 30. When it is decided to reuse container 80 for mailing purposes, such as sending the contents with writing or drawings thereon to another, the contents are replaced into container 80 and side flap 22 is tucked against the inside surface of side 30 again and tab 40 is folded along fold lines 53 and 57 and inserted into slot 26, locking flap 22 and side 12 to side 30. The container 80, as seen in FIG. 6, is now locked into mailable form and can be mailed as desired with one of the side panels 12, 14, or 16 bearing the mailing and return addresses.

It is understood that, in light of a reading of the foregoing description and drawings, those with ordinary skill in the art will be able to make changes and modifications to the present invention without departing from the spirit or scope of the invention, as defined in the following appended claims.

I claim:

1. A unitary blank having a multiplicity of fold, cut, and score lines permitting the blank to be folded along said fold and cut lines to form a container attached along a first score line to a display panel adapted to be hung from a merchandising display unit, said blank defining at least one locking slot and further having a first tab connected along a first folding line to a first panel and connected to said display panel along a second score line, said first tab being insertable in said slot when said display panel is separated from said container thereby causing said first panel to enclose said container and locking said container in mailable form.

2. The blank of claim 1 in which said display panel comprises a pair of panels connected along a second folding line, said panels being adhered together in an abutting relationship when said container and display panel are formed, one of said pair of panels connected along said first score line to said first panel while said other of said panels has a projection that extends below said score line when said container and display panel are formed thereby providing increased strength to said container and display panel in a region adjacent said first score line.

3. The blank of claim 2 in which said other of said panels has a pair of projections each extending below said first score line adjacent to said tab and said first folding line.

4. The blank of claim 3 in which said blank defines a second slot and said first panel has a second tab positioned on a side opposite said first tab for insertion into said second slot when said container is formed.

5. A one-piece carton blank for folding into a container to be hung from a point-of-purchase merchandising display unit and then, when removed from the arm, locked in a manner acceptable for mailing, said blank comprising a set of panels including a first panel defining a first slot and a first locking tab flap for engagement with said first slot, said panels being connected by fold lines such that, when said set is folded along said fold lines, said first container is formed, and a merchandising display panel adapted to be fastened to an arm of the merchandising display unit and connected by a first tear line to a second panel of said set, said second panel being integrally connected to said first locking tab, said first locking tab being insertable into said first slot only when said display panel is separated from said second panel thereby locking said container into mailable form.

6. The blank of claim 5 in which said locking tab is attached to said display panel by a second tear line.

7. The blank of claim 6 including a pair of merchandising panels, one merchandising panel being connected by said first tear line to said second panel and the other merchandising panel being longer that said one merchandising panel, said merchandising panels being connected to each other by a display fold line such that, when said panels are folded along said display fold line and said container is formed, said other merchandising panel is placed in a surface abutting relationship with said one merchandising panel and extending below said first tear line, and said extension of said other merchandising panel being in a surface abutting relationship with a tuck flap connected by a fold line to said first panel thereby providing rigidity to said merchandising display panels and securing said tuck flap in place without locking of said first tab within said first slot.

8. A display container adapted to be fastened to a merchandising display unit and capable of being locked into a mailable container comprising as a unitary body a display panel and a container unit having a first panel connected to said display panel across a tear line, said container unit having a locking tab and a top panel connected to a tuck flap and defining a slot positioned adjacent said locking tab, said tuck flap in a juxtaposed and parallel relationship with said first panel when said container is closed and said tab being insertable in said slot only when said display panel is removed from said first panel.

9. The display container of claim 8 in which said locking tab is connected to said display panel across a second tear line.

10. The display container of claim 8 wherein said display panel has an extension extending below said tear line and in a surface abutting relationship with said tuck flap.

11. The display container of claim 10 in which said locking tab is connected to said display panel, said container further including a pair of extensions of said display panel extending downwardly adjacent both sides of said locking tab and positioned in a surface abutting relationship with said tuck flap.

* * * * *